US005182582A

United States Patent [19]

Okamura

[11] Patent Number: 5,182,582

[45] Date of Patent: Jan. 26, 1993

[54] INK JET RECORDING APPARATUS WITH CLEANING MEANS THAT CLEANS LIGHTER-INK DISCHARGE PORTIONS BEFORE DARKER-INK DISCHARGE PORTIONS

[75] Inventor: Shigeru Okamura, Kawasaki, Japan

[73] Assignee: Canon Kabushiki Kaisha, Tokyo, Japan

[21] Appl. No.: 825,420

[22] Filed: Jan. 24, 1992

Related U.S. Application Data

[63] Continuation of Ser. No. 442,456, Nov. 30, 1989, abandoned, which is a continuation of Ser. No. 113,998, Oct. 29, 1987, abandoned.

[30] Foreign Application Priority Data

Oct. 31, 1986 [JP] Japan ..... 61-260026
Oct. 27, 1987 [JP] Japan ..... 62-270842

[51] Int. Cl.[5] ..... B41J 2/165
[52] U.S. Cl. ..... 346/140 R
[58] Field of Search ..... 346/140 R

[56] References Cited

U.S. PATENT DOCUMENTS

| | | | |
|---|---|---|---|
| 4,320,406 | 3/1982 | Heinzl | 346/140 |
| 4,511,907 | 4/1985 | Fukuchi et al. | 346/140 |
| 4,635,078 | 1/1987 | Sakurada | 346/140 |
| 4,675,696 | 6/1987 | Suzuki | 346/140 X |
| 4,745,414 | 5/1988 | Okamura | 346/140 |

FOREIGN PATENT DOCUMENTS

| | | |
|---|---|---|
| 3316970 | 11/1983 | Fed. Rep. of Germany . |
| 3611333 | 10/1986 | Fed. Rep. of Germany . |
| 3611666 | 10/1986 | Fed. Rep. of Germany . |
| 59-14964 | 1/1984 | Japan . |
| 45161 | 3/1984 | Japan . |
| 163571 | 8/1985 | Japan . |
| 230948 | 10/1986 | Japan . |

OTHER PUBLICATIONS

Nozzle Guard and Maintenance Station for Drop-On Demand Printheads; IBM Technical Disclosure Bulletin, vol. 27, No. 12, May 1985, pp. 6965-6967.

*Primary Examiner*—Joseph W. Hartary
*Attorney, Agent, or Firm*—Fitzpatrick, Cella, Harper & Scinto

[57] ABSTRACT

An ink jet recording apparatus has plural ink discharge portions, in corresponding recording heads, for discharging different color inks. The ink discharge portions are arranged with a discharge portion for relatively light ink always followed by a discharge portion for relatively dark ink (a given ink being lighter than another ink if the color of a mixture of those two inks is closer to the color of the other ink than to the color of the given ink). A carriage for scanning the recording heads causes a retractable cleaning member and the ink discharge portions to move relative to each other in a single direction so that the ink discharge portions are cleaned only in the order of lighter to darker inks. A second cleaning member is disposed at a position opposed to the first cleaning member to clean the first cleaning member. The second cleaning member includes an ink absorbing member and a plate-like member abutting the ink absorbing member and having an opening therein for causing ink droplets adhered to the plate-like member to be drawn into the ink absorbing member by capillary action.

10 Claims, 5 Drawing Sheets

21
23
24
50
49
C
4
5
6
3
3
2
III
1A
1B
1C
1D
37
36
III
18
19
20
16
14
15
21
I
I
B
13
12
23
25
17
24
RP
27
A
11
10
8
9
22D
22C
22B
22A
32
28
34
30
29
31
7

INK JET RECORDING APPARATUS WITH CLEANING MEANS THAT CLEANS LIGHTER-INK DISCHARGE PORTIONS BEFORE DARKER-INK DISCHARGE PORTIONS

This application is a continuation of application Ser. No. 07/442,456 filed Nov. 30, 1989, now abandoned, which in turn is a continuation of application Ser. No. 07/113,998, filed Oct. 29, 1987, now abandoned.

BACKGROUND OF THE INVENTION

1. Field of the Invention

The present invention relates to an ink jet recording apparatus having wiping means for cleaning the ink discharge port faces of the recording heads of the apparatus and to a method of cleaning such apparatus.

2. Related Background Art

An ink jet recording apparatus is such that ink is supplied into a recording head, discharge energy generating means (an electro-thermal converting member such as a heat generating resistor element or an electromechanical converting member such as a piezo element corresponding to an ink discharge port formed in the front face of the recording head is driven on the basis of a data signal, ink is caused to fly from the ink discharge port toward a sheet (a recording medium such as paper or plastic thin film) and droplets of this ink are caused to adhere thereto, thereby accomplishing recording.

In an ink jet recording apparatus of this type, for the purpose of preventing the ink discharge port from being clogged due to the increased viscosity of ink resulting from the evaporation of the solvent in the ink, the desiccation of the ink, the adherence of dust or the entry of bubbles, there is provided restoring means for carrying out the capping of the ink discharge port or the cleaning of the ink discharge port face as by wiping.

The function of such restoring means can be divided broadly into the function of cleaning the ink discharge port face and the ink suction function of removing bubbles in the ink discharge port and ink which has increased in viscosity.

Now, in an ink jet recording apparatus for color images, use may be made of inks of plural colors and a plurality of recording heads corresponding to the respective colors. In such case, the colors of the inks used are usually four colors such as cyan, magenta, yellow and black.

Also, in some cases, recording is effected by the use of a plurality of inks identical in hue and differing in light and shade, and again in such cases, a plurality of recording heads are carried on the apparatus in conformity with the number of the inks.

In an ink jet recording apparatus provided with a plurality of recording heads for discharging such inks of plural colors respectively, cleaning means for cleaning the ink discharge port face of each recording head becomes necessary.

In such case, the provision of cleaning means for each recording head has led to the problem that the number of parts is increased and the structure of the apparatus becomes complex and the reliability of the apparatus is reduced. Also, juxtaposition of the cleaning means has led to a greater width of the recording apparatus, which in turn has prevented the apparatus from being made compact and light in weight.

If, therefore, all the ink discharge port faces of the plurality of recording heads are cleaned by a single cleaning means, there has sometimes arisen the problem that mixing of the inks of plural colors occurs on the cleaning means while the cleaning is repeatedly effected. This has sometimes resulted in the occurrence of the problem that the mixed inks having adhered to the cleaning means adhere from the cleaning means back to the ink discharge ports and the colors of the inks discharged from the ink discharge ports are changed thereby during the recording operation.

SUMMARY OF THE INVENTION

It is an object of the present invention to provide an ink jet recording apparatus which can solve the above-noted problems peculiar to the prior art and in which the ink discharge port faces of recording heads can be effectively cleaned by a simple structure, and a method of cleaning such apparatus.

It is another object of the present invention to provide an ink jet recording apparatus characterized by a plurality of discharge ports for discharging inks of different colors, and cleaning means for cleaning said discharge ports in succession from a light color to a dark color.

It is still another object of the present invention to provide a method of cleaning an ink jet recording apparatus, characterized by the step of cleaning a plurality of discharge ports for discharging inks of different colors, in succession from a light color to a dark color by cleaning means.

DESCRIPTION OF THE PREFERRED EMBODIMENT

The present invention will hereinafter be described specifically with reference to the drawings.

Figures 1, 2:
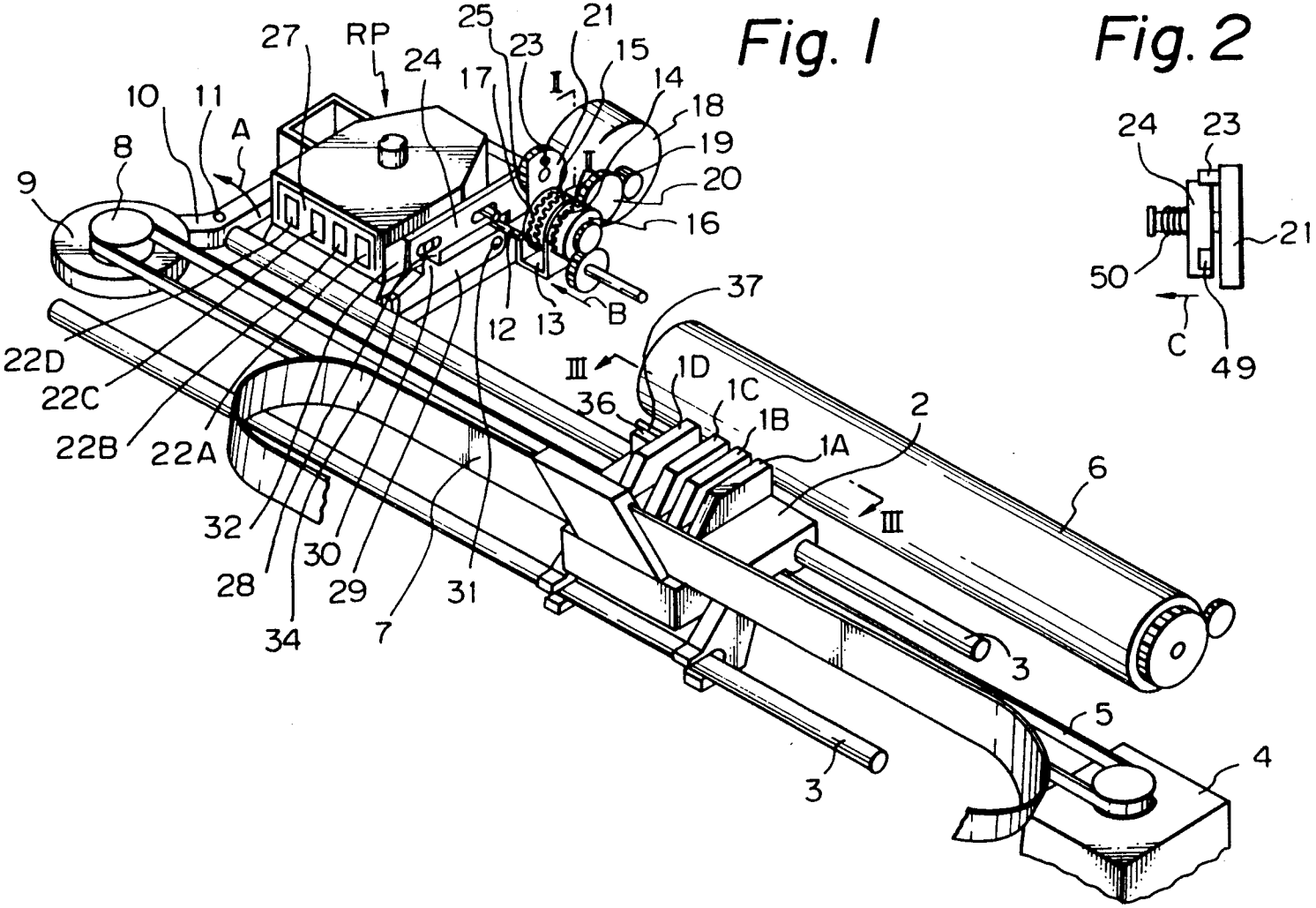
FIG. 1 is a schematic perspective view showing the construction of the essential portions of an embodiment of an ink jet recording apparatus according to the present invention.
FIG. 2 is a schematic front view taken along line II—II in FIG. 1.

FIG. 1 is a schematic perspective view showing the construction of the essential portions of an embodiment of the ink jet recording apparatus of the present invention.

In FIG. 1, a carriage 2 carrying a plurality of (in the illustrated embodiment, four) recording heads 1A, 1B, 1C and 1D is supported and guided by pair of guide shafts 3.

The drive force of a carriage motor 4 is transmitted to the carriage 2 through a timing belt 5, so that the carriage slides on the pair of guide shafts 3 and moves along a platen 6. The carriage 2 reciprocally scans with forward and reverse revolutions of the motor 4. A predetermined gap (for example, of the order of 0.8 mm) is provided between the front faces (the discharge port faces in which ink discharge ports are formed) of the recording heads 1A-1D on the carriage and the platen 6 (more particularly, a sheet supported by the platen).

During the scanning movement of the carriage 2, a recording signal is input to the recording heads 1A-1D through flexible wiring 7, and the recording heads 1A-1D are driven at a timing associated with the position of the carriage 2 to discharge inks, thereby accomplishing recording on a sheet (a recording medium such as paper or plastic thin film) on the platen 6.

During recording, dust or paper scraps may adhere to the vicinity of the ink discharge port(s) of the recording heads 1A-1D or air may be introduced through the ink discharge port(s), thereby causing unsatisfactory discharge of inks.

Generally, in an ink jet recording apparatus, there is installed restoring means RP for restoring such unsatisfactory discharge of inks.

When a restoring key (not shown) is operated to restore the unsatisfactory discharge of inks, the recording operation is interrupted and the carriage 2 is moved toward the restoring means RP.

With this movement of the carriage 2 toward the restoring means RP, an idle pulley 8 supporting the rotation of the timing belt 5 at one end thereof is rotated. With this rotation of the idle pulley 8, a planetary gear group 9 for speed reduction is also rotated which is provided coaxially therewith.

When the carriage 2 moves to a predetermined position toward the restoring means RP, a lever 10 engaged with a can slot in the last gear (not shown) of the planetary gear group 9 is pivotally moved about a shaft 11 in the direction of arrow A by an amount determined by the cam slot.

As the lever 10 is pivotally moved in the direction of arrow A, a stay 12 engaged with the fore end of the lever 10 slides in the direction of arrow B and a plate 13 fixed to the stay 12 also moves in the direction of arrow B.

This plate 13 is engaged with the circumferential groove 15 of a ratchet gear 14, which is free to rotate but is axially movable with the plate 13.

Accordingly, when the plate 13 moves in the direction of arrow B, the ratchet gear 14 is changed over from a state in which it is in meshing engagement with a ratchet gear 16 to a state in which it meshes with a ratchet gear 17.

Upon this change-over, the revolution of a sheet feeding motor (hereinafter referred to as the LF motor) 18 may be transmitted to the ratchet gear 17 through an LF motor gear 19, an idle gear 20 and the ratchet gear 14.

The ratched gear 17 has formed integrally therewith a gear portion which is in meshing engagement with a gear 21 with a dowel. This gear 21 with a dowel is the input gear of the restoring means RP and therefore, upon the aforementioned change-over to the direction of arrow B, the restoring means RP becomes driven by the LF motor 18.

The position of the carriage 2 is controlled with the home position detected by a home position sensor (not shown) installed at the left end portion being as the reference.

When the restoring key is operated as previously mentioned, the carriage 2 moves to a position in which the recording heads 1A-1D are opposed to corresponding caps 22A, 22B, 22C and 22D, respectively. In this position, as previously described, the LF motor 18 is changed over to the driving side of the restoring means RP and accordingly, the restoring operation is performed.

A wiping operation for cleaning the ink discharge port faces (the faces in which the ink discharge ports are formed) of the recording heads 1A-1D is carried out as one restoring operation, and wiping means therefor will hereinafter be described. This wiping means is designed to wipe the ink discharge port faces by means of a cleaning blade 24.

As the LF (line feed) motor 18 revolves, the gear 21 with a dowel is rotated and the dowel 23 comes into engagement with the rear end portion 25 of the cleaning blade 24, and the cleaning blade is protruded toward the carriage 2 against the force of a return spring (not shown) which biases the cleaning blade toward the LF motor 18.

The LF motor 18 is stopped when the gear 21 with a dowel has rotated from its initial position of FIG. 1 to a position in which the dowel 23 presses and displaces the rear end portion 25 of the cleaning blade 24.

By the aforementioned revolution of the LF motor 18, the rotary cam (not shown) of the restoring means RP which rotates at the final deceleration is also rotated at the same time, and a cap housing 27 which supports rubber caps 22A-22D tends to move toward the recording heads 1A-1D, but since the reduction ratios of the gear 21 with a dowel and the rotary cam of the restoring means RP from the LF motor 18 differ greatly from each other, the movement of the cap housing 27 can be neglected, and the gaps between the caps 22A-22D and the recording heads 1A-1D hardly vary, and the caps and the recording heads do not contact with each other.

Figure 5:
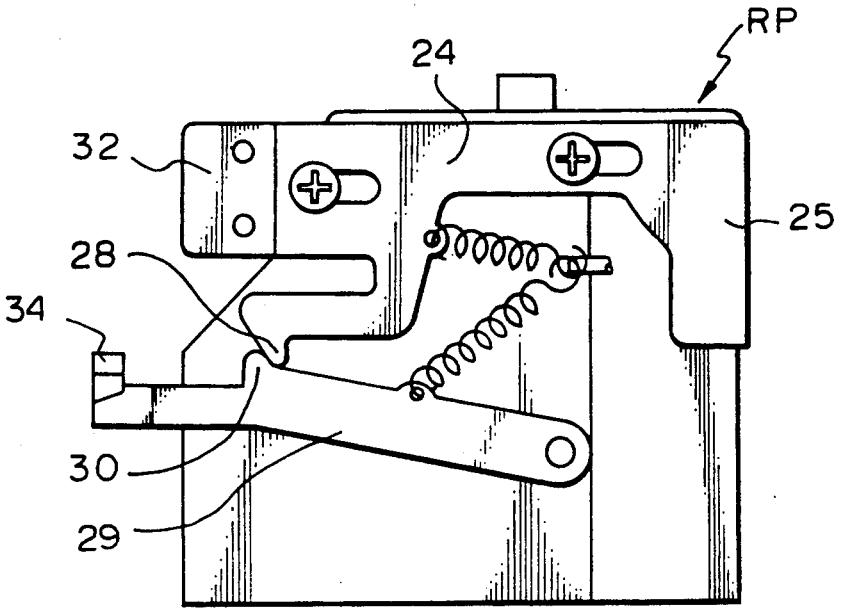
FIG. 5 is a schematic side view of wiping means taken along line V—V in FIG. 4.

When the cleaning blade 24 constituting the wiping means is protruded by the rotation of the gear 21 with a dowel, the pawl 28 of the cleaning blade 24 depresses the pawl 30 of a holding lever 29 pivotally connected to the lower portion thereof and operates so as to ride over the latter (FIG. 5).

Accordingly, the holding lever 29 is rotated counterclockwise direction about a lever shaft 31 against the force of a return spring (not shown), and the pawl 28 of the cleaning blade 24 is caught by the pawl 30 of the holding lever 29, whereby the cleaning blade 24 is held in its protruded position.

With the cleaning blade 24 being protruded, the carriage 2 is moved toward the platen 6 (rightwardly as viewed in FIG. 1), and wiping of the ink discharge port faces of the recording heads 1A-1D is effected by a blade 32 attached to the tip end of the cleaning blade 24.

Figure 3:
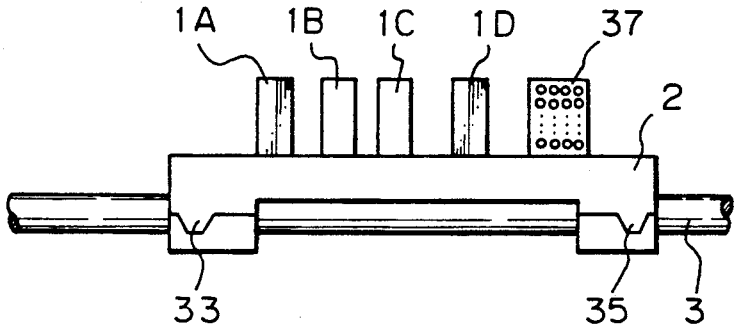
FIG. 3 a schematic front view of a carriage taken along line III—III in FIG. 1.
Figure 4:
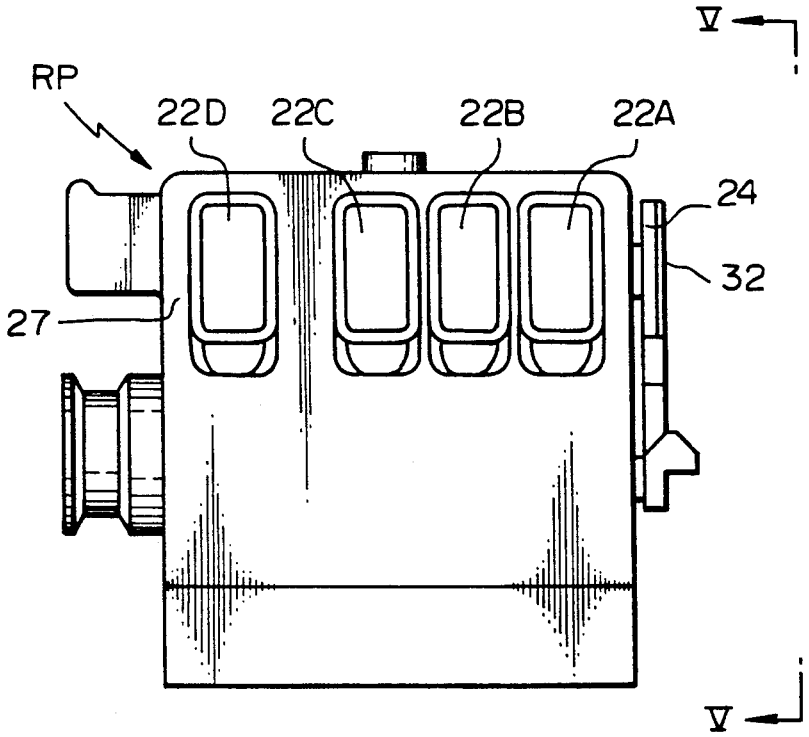
FIG. 4 is a schematic front view showing the restoring means in FIG. 1.

When the carriage 2 is thus moved from left to right, the resetting pawl 33 (FIG. 3) of the carriage 2 comes into engagement with the end pawl 34 of the holding lever 29, and the holding lever 29 is depressed counterclockwise as viewed in FIG. 1, whereby the engagement between the pawl 28 of the cleaning blade 24 and the pawl 30 of the holding lever 29 is released temporarily.

Therefore, the cleaning blade 24 tends to retract away from the recording heads 1A-1D due to the action of a return spring (FIG. 5), but in this case, the cleaning blade 24 is prevented from retracting by the gear 21 with a dowel and therefore, even if the resetting pawl 33 of the carriage 2 passes, the cleaning blade is held in its protruded position.

During the time that the carriage 2 is further moved rightwardly, wiping of the ink discharge port faces of the recording heads 1A–1D is effected.

In this case, in the period which is before the revolutionary force of the LF motor 18 is changed to the platen 6 driving side by the movement of the carriage 2 and during which the pawl 30 of the holding lever 29 is positioned between the pair of resetting pawls 33 and 35 (FIG. 3) of the carriage 2, the LF motor 18 is changed over to the reverse revolution opposite to the forward revolution during the restoring operation and is reversely revolved to its initial position, and the gear 21 with a dowel is returned to its position of FIG. 1.

By the reverse revolution of the LF motor 18, the gear 21 with a dowel makes one or more full reverse rotations, but in that case, the dowel 23 of the gear 21 with a dowel passes through an escape groove 49 (FIG. 2) at the rear end 25 of the cleaning blade 24 and gradually returns to its original position while raising the cleaning blade 24 in the direction of arrow C (FIG. 2) against the force of a spring 50 (FIG. 2). Therefore, the cleaning blade 24 does not protrude to the ink discharge port side.

The sequence of wiping of the plurality of recording heads 1A–1D is chosen such that the recording head for discharging ink of light color is cleaned at first and the recording head for discharging ink of dark color is cleaned lastly. By this, color mixing in the course of wiping can be made entirely inconspicuous.

For example, where the ink jet recording apparatus of FIG. 1 is a color printer using inks of four colors, i.e., cyan, magenta, yellow and black, it is preferable the recording head 1A to be wiped at first be one which discharges yellow ink and the recording head 1D to be wiped lastly be one which discharges black ink. The intermediate recording heads 1B and 1C are chosen to be cyan and magenta respectively.

Yellow, cyan, magenta and black herein referred to, if expressed specifically in numerical values by "CIE 1976 (L*a*b*) Color Space" defined by C.I.E. (International Illumination Committee), are colors in the vicinity of the following:

| | L* | a* | b* |
|---|---|---|---|
| Yellow | 97 | −10 | 42 |
| Cyan | 79 | −32 | −33 |
| Magenta | 73 | 65 | −16.5 |
| Black | 43 | 10 | −20 |

In the case of a recording apparatus using light and dark inks of the same hue, it is preferable to choose a light color to a dark color in the order of the recording heads 1A–1D.

The definition of the "light color" and "dark color" when use is made of light and dark inks of the same hue is as follows:

| | |
|---|---|
| Light color: | high in brightness, high in chroma |
| Dark color: | low in brightness, low in chroma |

Examples of the light color and dark color in the present invention are shown in Table 1 below.

TABLE 1

| No. | 1 | 2 | 3 | 4 |
|---|---|---|---|---|
| Light color | Yellow | Yellow | Yellow | Cyan |
| Dark color | Cyan | Magenta | Black | Black |

| No. | 5 | 6 | 7 |
|---|---|---|---|
| Light color | Magenta | Yellow (high brightness) | Yellow (high chroma) |
| Dark color | Black | Yellow (low brightness) | Yellow (low chroma) |

| No. | 8 | 9 | 10 |
|---|---|---|---|
| Light color | Cyan (high brightness) | Cyan (high chroma) | Magenta (high brightness) |
| Dark color | Cyan (low brightness) | Cyan (low chroma) | Magenta (low brightness) |

| No. | 11 | 12 | 13 |
|---|---|---|---|
| Light color | Magenta (high chroma) | Black (high brightness) | Black (high chroma) |
| Dark color | Magenta (low chroma) | Black (low brightness) | Black (low chroma) |

In the present invention, where use is made of ink A of a certain color and ink B of a different color, when the color of the mixture of these inks is more approximate to the color of said ink B than to the color of said ink A, the color of said ink A is regarded as light color and the color of said ink B is regarded as dark color.

Removal of foreign substances such as ink droplets or dust which have adhered to the cleaning blade 24 by the ink discharge port faces being wiped is effected, for example, by the use of second cleaning means having a support plate 37 provided on the carriage and an absorber 36 supported by the support plate 37.

After the termination of the cleaning of the discharge port faces of the recording heads 1A, 1B, 1C and 1D (the state of FIG. 6(A)), the carriage 2 is further moved in the direction of arrow FD, and in the state of FIG. 6(B), foreign substances such as ink droplets or dust having adhered to that side of the cleaning blade 24 which is designated by 24-1 are removed by the edge 37-1 of the support plate 37 and absorbed by the absorber 36. Removal of foreign substances such as ink droplets or dust having come round and adhered to that side of the cleaning blade 24 which is designated by 24-2 is accomplished by moving the carriage 2 to the state of FIG. 6(C) relative to the cleaning blade 24, thereafter moving the carriage 2 in the direction of arrow BK, removing the foreign substances by the edge 37-2 of the support plate 37 in the state of FIG. 6(D), and absorbing the foreign substances by the absorber 36.

The carriage 2 is further moved from the state of FIG. 6(D), and the cycle of removing the ink droplets having adhered to the cleaning blade 24 is terminated in the state of FIG. 6(A).

Removal of ink droplets may be accomplished by the cycle of returning from the operation in the abovedescribed sequence of FIGS. 6(A), (B), (C) and (D) to the state of FIG. 6(A) via the movement in the direction of arrow C (FIG. 2) and repeating a similar operation, and the cleaning effect will be further enhanced if such cycle is repeated plural times.

Figure 6:
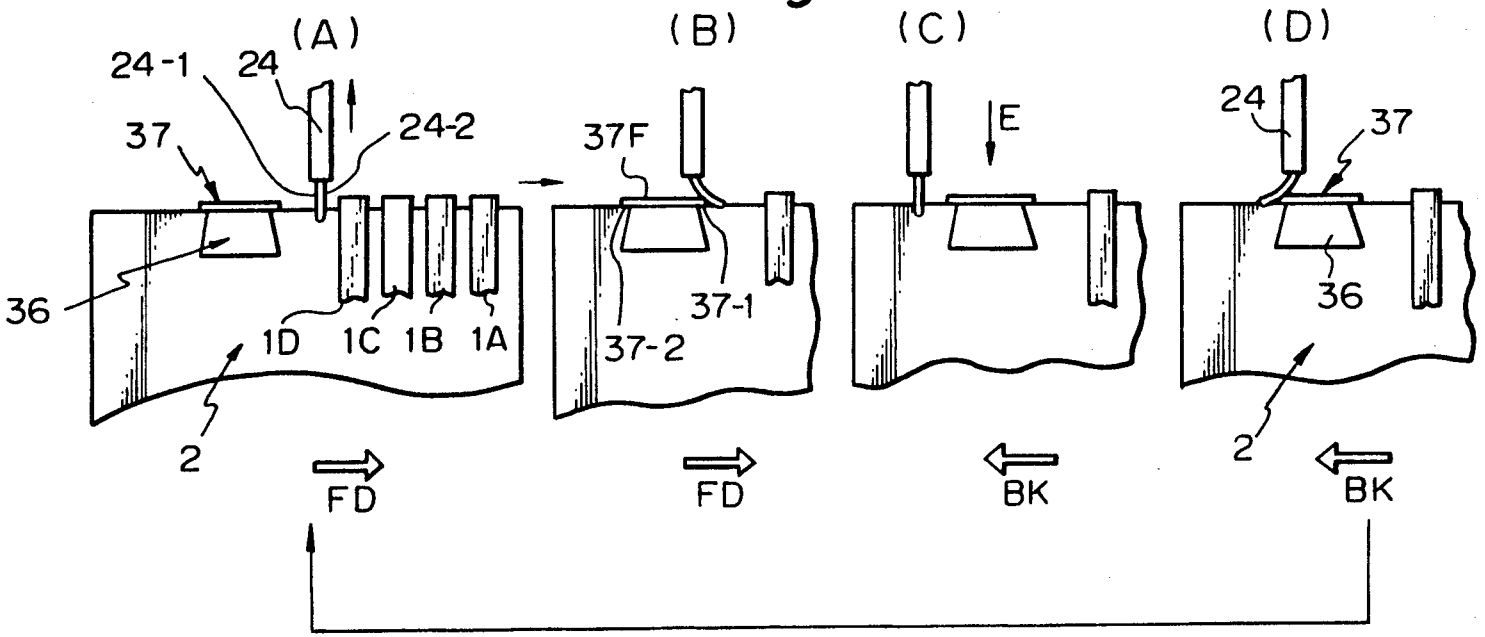
FIG. 6(A)-(D) are schematic fragmentary front views for illustrating the cleaning operation of the wiping means.
Figure 7:
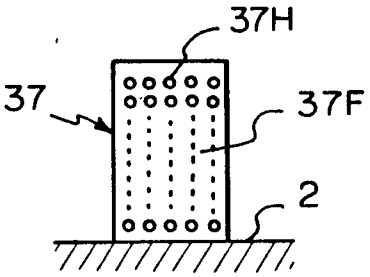
FIG. 7 is a schematic front view of a support plate 35 in FIG. 6.

In FIG. 7 which shows a schematic front view of the support plate or plate like member for the absorber 36 as seen in the direction of arrow E in FIG. 6, a number of small apertures or openings 37H are formed in the flat portion 37F of the support plate 37 for the absorber 36, and ink droplets which could not be removed by the edges 37-1 and 37-2 during the aforedescribed operation of removing the ink droplets having adhered to the cleaning blade 24 move into the small apertures 37H due to the capillary force of the small apertures 37H during the time that the cleaning blades 24-1 and 24-2 lick the flat portion 37F and are absorbed by the absorber 36.

The above-described cleaning operation by the wiping means may be executed plural times with the carriage 2 reciprocally moved.

Figure 8:
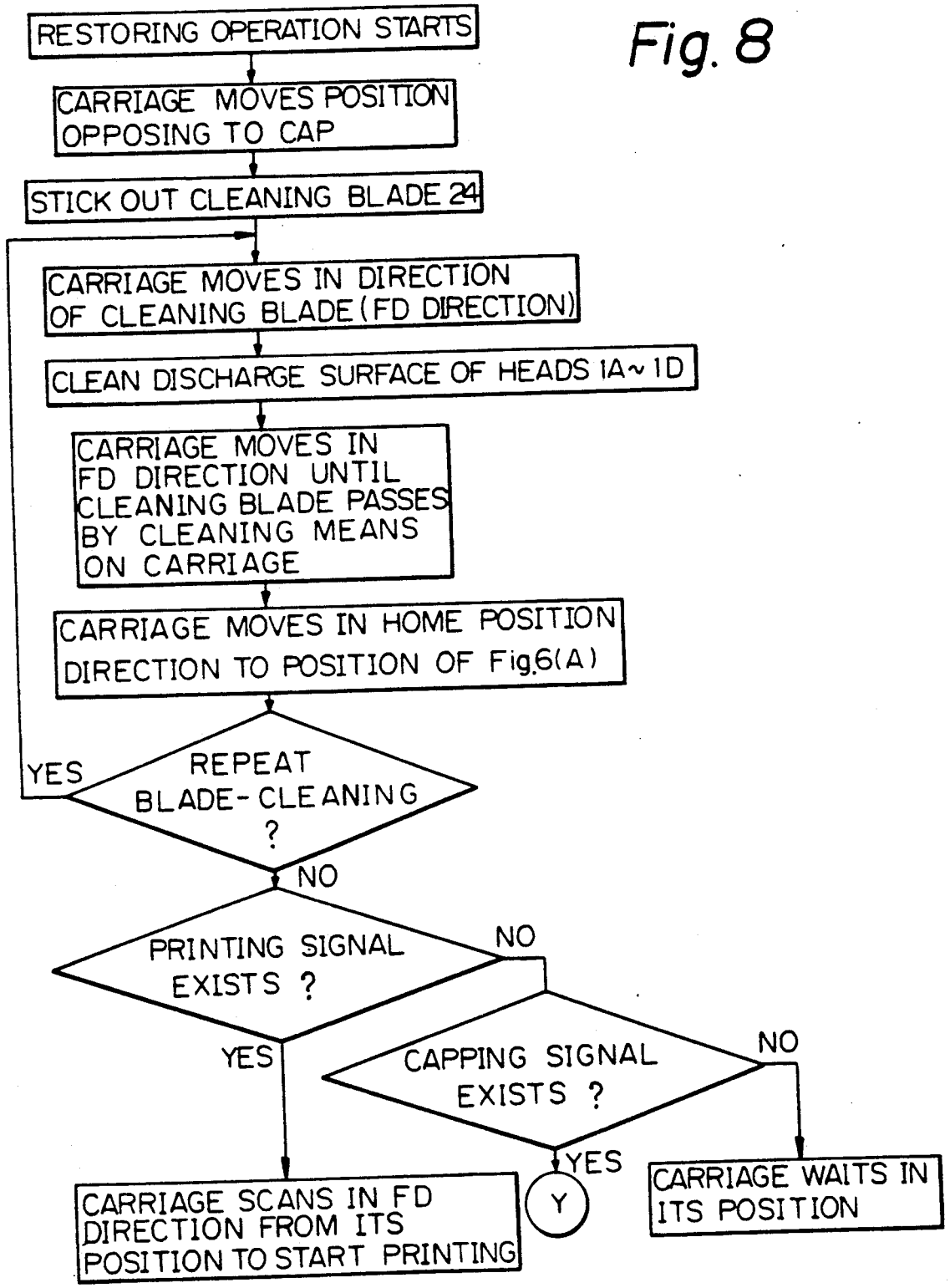
FIG. 8 is a flow chart for explaining the restoring operation of the ink jet recording apparatus of the present invention.

The flow of the above-described wiping of the discharge port faces of the recording heads 1A-1D and cleaning of the cleaning blade 24 will now be supplementally described with reference to the restoring operation flow chart of FIG. 8.

Cleaning of the recording heads 1A-1D and cleaning blade 24 is terminated and the carriage 2 waits in the position of FIG. 6(A) relative to the cleaning blade 24, (See the step at which the carriage 2 moves to the position.) of FIG. 6(A) toward the home position. At this step, the carriage 2 moves from the position of FIG. 6(C) to the position of FIG. 6(A) via the position of FIG. 6(D).

The subsequent steps between the step at which the discharge port faces of the recording heads 1A-1D are cleaned and the step at which the carriage 2 moves to a predetermined position (until the blade 24 passes by the cleaning means) are the steps for cleaning the blade. The step at which the carriage 2 moves to the predetermined position corresponds to FIGS. 6(A)-(C).

Advance is made to a step at which whether cleaning of the blade 24 should be repeated is judged, and if it is desired to repeat the cleaning, it is also possible to skip between a step at which the blade 24 is protruded and a step at which the carriage 2 moves toward the blade 24. At the step whereat the necessity of repeating the cleaning of the blade 24 is judged, if the answer is NO, advance is made to a step at which the presence of a printing signal is judged, and if judgment YES is formed at that step, the carriage 2 moves in the direction of arrow FD and starts printing from a predetermined position. At that time, the cleaning blade 24 goes through the states of FIGS. 6(B) and (C). The cleaning blade 24 returns to its initial position by the resetting pawl 35 of the carriage 2 depressing the holding lever 29.

When no printing signal is present (that is, when judgment NO is formed), advance is made to a step at which the presence of a capping signal is judged, and when no capping signal is present (that is, when judgment NO is formed), the carriage 2 waits in that position. On the other hand, when a capping signal is present (that is, when judgment YES is formed), advance is made to step (Y).

Step (Y) will now be described. Step (Y) is the state of FIG. 6(A) and therefore, when the carriage 2 is scanned toward the home position (in the direction of arrow BK), the cleaning blade 24 will wipe the discharge port faces of the recording heads in the direction from the head 1D toward the head 1A. For this reason, the carriage 2 is once scanned in the direction of arrow FD and the cleaning blade 24 is returned to its initial position by the resetting pawl 35, whereafter the carriage 2 may be scanned in the direction of arrow BK.

While the above embodiment has been described with respect to a case where the discharge port faces of a plurality of recording heads for discharging inks of plural colors are wiped, the present invention is not restricted thereto.

For example, the present invention is also applicable to the wiping of the discharge port face of a recording head having a plurality of discharge ports for discharging inks of plural colors.

Figure 9:
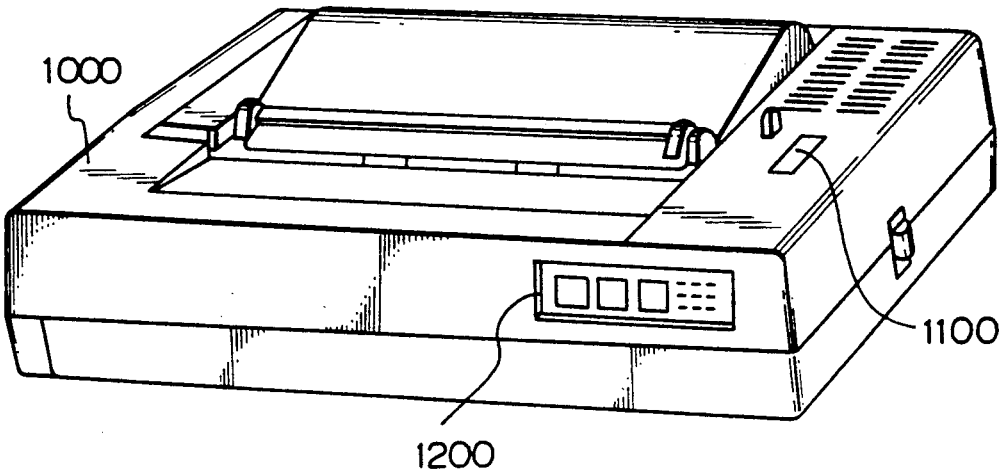
FIG. 9 is a schematic pictorial perspective view showing the ink jet recording apparatus of the present invention.

Referring to FIG. 9 which is a schematic pictorial perspective view showing an embodiment of the ink jet recording apparatus of the present invention, the reference numeral 1000 designates an ink jet recording apparatus body, the reference numeral 1100 denotes a main switch, and the reference numeral 1200 designates an operating panel.

According to the embodiment described above, the ink discharge port faces of the plurality of recording heads 1A-1D are effectively wiped in a predetermined order by a single cleaning blade 24, whereby dust, paper scraps or viscosity-increased ink adhering to the ink discharge port faces of the recording heads can be reliably removed.

Also, since wiping of the recording heads 1A-1D is carried out by one and the same cleaning blade 24, the structure of the wiping means can be made fewer in the number of parts and simple as well as compact and highly reliable, and this leads to the possibility of the compactness, lighter weight and reduced cost of the ink jet recording apparatus.

As is apparatus from the foregoing description, according to the present invention, the wiping means for cleaning the ink discharge port faces of the recording heads can be made simple and compact and improved in reliability, whereby there can be provided an ink jet recording apparatus which can generally be made light in weight and compact.

I claim:

1. An ink jet recording apparatus comprising:

recording means having a first recording head having a first ink discharge opening for discharging a first ink and a second recording head having a second ink discharge opening for discharging a second ink lighter than the first ink side by side, a given ink being lighter than another ink if the color of a mixture of those two inks is closer to the color of the other ink than to the color of the given ink;

cleaning means for cleaning said recording heads one after the other;

setting means for setting said cleaning means in a cleaning or a non-cleaning position;

a reciprocable carriage for moving said first and second recording heads across said cleaning means when said cleaning means is in the cleaning position to clean said recording heads in a predetermined order so that the recording head for a lighter ink is never cleaned after ea recording head for the darker ink; and a releasing member at the downstream side of said carriage for releasing said cleaning means and placing said cleaning means into the non-cleaning position, wherein said cleaning means is cleaned by second cleaning means disposed on the downstream side of said carriage and thereafter said first-mentioned cleaning means is placed into the non-cleaning position.

2. An ink jet recording apparatus according to claim 1, wherein said setting means comprises first moving means for moving said first mentioned cleaning means to the cleaning position and second moving means for moving said first mentioned cleaning means to the non-cleaning position.

3. An ink jet recording apparatus according to claim 2, wherein said first moving means comprises a motor, means for converting rotational movement of the motor into advancing movement for advancing said first mentioned cleaning means to the cleaning position and latching means for latching said first mentioned cleaning means.

4. An ink jet recording apparatus according to claim 3, wherein said latching means comprises a first member for engaging the rear end surface of said first mentioned cleaning means and advancing said first mentioned the cleaning means to cleaning position, and a second member for engaging said first mentioned cleaning means and holding said first mentioned the cleaning means in cleaning position.

5. An ink jet recording apparatus according to claim 4, wherein said second moving means comprises means for releasing said cleaning means from the cleaning position by causing said second member to contact said releasing member on said carriage, and a spring member applying tension force to said cleaning means in the non-cleaning position direction.

6. An ink jet recording apparatus according to claim 1 wherein said first mentioned cleaning means is a flexible blade.

7. An ink jet recording apparatus for recording using plural inks, the apparatus comprising:

first cleaning means;

plural ink discharge portions for discharging different inks, said ink discharge portions being disposed for cleaning by said cleaning means in succession, wherein said plural ink discharge portions are arranged successively in the order of a discharge portion for discharging relatively light ink always followed by a discharge portion for discharging relatively dark ink, a given ink being lighter than another ink if the color of a mixture of those two inks is closer to the color of the other ink than to the color of the given ink;

driving means for driving said cleaning means and said ink discharge portions relative to each other in a predetermined single direction so that said ink discharge portions are cleaned only in said order of lighter to darker inks; and second cleaning means for cleaning said first cleaning means after said discharge portions have been cleaned, wherein said second cleaning means is disposed at a position opposed to said first cleaning means and includes an ink absorbing member and a plate-like member abutting said ink absorbing member and having an opening therein for causing ink droplets adhered to said plate-like member to be drawn into said ink absorbing member by capillary action.

8. An ink jet recording apparatus according to claim 7, wherein said second cleaning means includes an ink absorbing body for slidingly abutting said first cleaning means to remove ink attached to said first cleaning means by capillary action.

9. An ink jet recording apparatus according to claim 7, wherein said first cleaning means is a flexible blade.

10. An ink jet recording apparatus for recording using plural inks, the apparatus comprising:

first cleaning means;

plural ink discharge portions for discharging different inks, said ink discharge portions being disposed for cleaning by said cleaning means in succession, wherein said plural ink discharge portions are arranged successively in the order of a discharge portion for discharging relatively light ink always followed by a discharge portion for discharging relatively dark ink, a given ink being lighter than another ink if the color of a mixture of those two inks is closer to the color of the other ink than to the color of the given ink;

driving means for driving said cleaning means and said ink discharge portions relative to each other in a predetermined single direction so that said ink discharge portions are cleaned only in said order of lighter to darker inks; and second cleaning means for cleaning said first cleaning means after said discharge portions have been cleaned, wherein said second cleaning means slidingly abuts said first cleaning means to remove ink attached to said first cleaning means.

* * * * *

UNITED STATES PATENT AND TRADEMARK OFFICE

CERTIFICATE OF CORRECTION

PATENT NO. : 5,182,582

DATED : January 26, 1993

INVENTOR(S) : SHIGERU OKAMURA

It is certified that error appears in the above-identified patent and that said Letters Patent is hereby corrected as shown below:

COLUMN 1

Line 25, "head" should read --head)--.

COLUMN 2

Line 47, "35" should be deleted.

COLUMN 3

Line 38, "can" should read --cam--.
Line 60, "ratched" should read --ratchet--.

COLUMN 8

Line 57, "ea" should read --a--.

COLUMN 9

Line 15, "the" should be deleted.
Line 16, "to cleaning" should read --to the cleaning--.
Line 18, "the" should be deleted.
Line 19, "cleaning" should read --the cleaning--.
Line 22, "cleaning means" should read --first mentioned cleaning means--.
Line 25, "cleaning means" should read --first mentioned cleaning means--.

--

UNITED STATES PATENT AND TRADEMARK OFFICE

CERTIFICATE OF CORRECTION

PATENT NO. : 5,182,582

DATED : January 26, 1993

INVENTOR(S) : SHIGERU OKAMURA

It is certified that error appears in the above-identified patent and that said Letters Patent is hereby corrected as shown below:

COLUMN 9

Line 28, "1" should read --1,--.

Signed and Sealed this

First Day of March, 1994

Bruce Lehman

*Attest:*

BRUCE LEHMAN

*Attesting Officer*

*Commissioner of Patents and Trademarks*